United States Patent [19]

von der Eltz

[11] 4,047,403

[45] Sept. 13, 1977

[54] APPARATUS FOR THE CONTINUOUS WET TREATMENT OF TEXTILES IN ROPE FORM

[75] Inventor: Hans-Ulrich von der Eltz, Frankfurt am Main, Germany

[73] Assignee: Hoechst Aktiengesellschaft, Frankfurt am Main, Germany

[21] Appl. No.: 716,242

[22] Filed: Aug. 20, 1976

[30] Foreign Application Priority Data

Aug. 23, 1975 Germany ..... 2537665

[51] Int. Cl.[2] ..... D06B 23/18

[52] U.S. Cl. ..... 68/5 E; 34/242

[58] Field of Search ..... 68/5 E; 34/242

[56] References Cited

U.S. PATENT DOCUMENTS

| | | | |
|---|---|---|---|
| 2,873,597 | 2/1959 | Fahringer | 68/5 E |
| 3,032,812 | 5/1962 | Van Riper | 34/242 X |
| 3,066,006 | 11/1962 | Sonnino | 68/5 E X |
| 3,478,546 | 11/1969 | Serbin | 68/5 E |

*Primary Examiner*—Philip R. Coe

*Attorney, Agent, or Firm*—Curtis, Morris & Safford

[57] ABSTRACT

Sealing device for the continuous inlet and outlet of textile material in the form of endless ropes into and from a pressure-tight container under high temperature conditions, consisting of a number of locks of graduated pressure, which are positioned one behind the other in the transport direction of the rope, and characterized in that each pressure lock is a sealing element made of elastic material in the form of the common shell of two frusta of straight circular cones of different height, which abut on each other axially with their top faces, and which face, in the direction toward the open base of the lower frustum the room under higher pressure, and whose internal surface is lined with a smooth layer and the inner diameter of the sealing element approximately corresponds to the diameter of the cylindrically shaped textile rope, so as to be tightly pressed from all sides onto the textile material under the action of the higher internal pressure exerted in the pressure container on the outer shell of the frusta.

5 Claims, 8 Drawing Figures

APPARATUS FOR THE CONTINUOUS WET TREATMENT OF TEXTILES IN ROPE FORM

Figure 1:
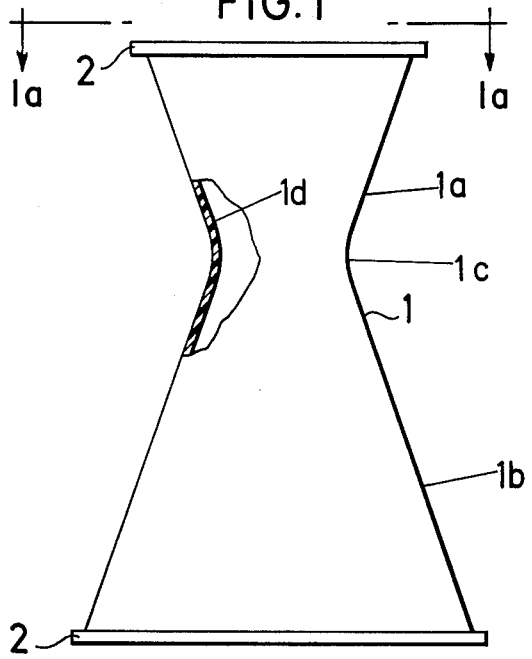

The present invention relates to an apparatus for the continuous wet treatment of textiles in rope form.

Textile material in rope form is being dyed on an industrial scale only batchwise on winch-becks and recently also on jet dyeing units; continuous dyeing on winch-becks has not yet been possible for reasons of levelness. Methods for a continuous treatment of textiles in rope form presently involve two major problems: One is irregular impregnation, the other is the failure to continuously introduce textile material in rope form into a pressure container.

All attempts to dye textiles in rope form continuously have hitherto failed, since it has been impossible to continuously dye compressed, hence varyingly compact, rope material in level shades. This applies particularly to high-quality synthetic fibrous material in rope form. It is easily possible to bleach, desize or dye such a material at open width in the form of parallel-run fibers (tows, combed material) or even filaments, or circular knit material that has been cut up or stretched out. However, owing to irregular density of the fibers at twisted points, the rope material as described above has a different permeability to the treatment liquor as it alternatingly shows compact passages which are relatively impermeable to liquid as well as passages that are easily penetrated by the liquor. Moreover, the greatly varying physical property of the rope material brings about different flow directions, caverns, vacancies and also such material sections which are penetrated by no, or only very little, liquid.

A dyeing process, according to which textile material in rope form is first impregnated, and then the wet material is to be introduced into a pressure container through a sealing element, cannot be put into practice in this form as both impregnation would be irregular, no matter what chemical agents or dyes would be used, and when introduced in wet condition, the impregnation bath would inevitably be stripped off in an uncontrollable manner at the sealing elements.

Industry is, however, keenly interested in continuously operated treatment methods for textiles in rope form since these methods particularly allow the structure of synthetic fibers to be maintained and the conventional, discontinuous methods to be replaced by profitable ones.

It has now been found that textile material in rope form can regularly be penetrated by a wet treatment liquor at all points under elevated pressure, i.e. by operating under high temperature conditions, which again require the necessity of establishing the necessary high pressure for this process. Contrary to the conventional opinion held by those skilled in the art and almost in contradiction to practical experience, I have now construed an apparatus that allows textile material in rope form to be treated continuously under high temperature conditions by continuously introducing the fibrous material that has been impregnated with the liquor, as an endless rope through several pressure locks into a storage system, allowing it to dwell there for a short time under high temperature conditions and then removing it from the pressure container through pressure locks of the same type.

Hence, the present invention provides a sealing device for the continuous inlet and outlet of, optionally wet, textile material in the form of endless ropes into and from pressure-tight containers under high temperature conditions, the device consisting of a number of locks of graduated pressure, arranged one behind the other in the transport direction of the rope, wherein each pressure lock is a funnel-shaped sealing element made of elastic material in the form of the common shell of two frusta of straight circular cones of different height, which abut on each other axially with their top surfaces and which face, in the direction toward the open base of the lower frustum, the room under higher pressure, and whose internal surface is lined with a smooth layer and the inner diameter, at the joining surface (coinciding surface) of the two frusta approximately corresponds to that of the cylindrically shaped textile rope that passes this "neck", so as to be tightly pressed from all sides onto the textile material under the action of the higher internal pressure exerted in the pressure container on the outer shell of the frusta.

The sealing elements of the invention render possible the continuous wet treatment of textile articles in rope form when used as pressure locks for the inlet and outlet in and from pressure-tight containers. The elements consist of the above-described shell made of natural rubber or another elastic material, whose internal surface is lined with a smooth layer, preferably of polytertrafluoroethylene, to improve its smoothness. In such a case, the shell of the double-cone frustum may be of one piece of the materials mentioned or may be composed of a number of axially parallel strips that overlap one another twice or three times, and which are kept together and reinforced by rings of the same material at the edges of the bases of the two frusta and which seal each other and on the rope under the action of the pressure exerted onto the outer surface of the frustum. It is also advisable to provide the first-mentioned sealing element made of one piece with reinforcing rings at both ends of the shell of the double-cone frusta.

In a particular embodiment of the sealing device of the invention, the sealing element consists of the shell of a double-cone frustum split up into overlapping strips (lamellae) which rest, with both their ends, in rotatable but rigid rings fixed at the bases' edges of the body formed in this manner by the two frusta. When these rings are twisted against one another (torsion of 70° to 120°), the inner diameter of the sealing element can be varied at the joining face (coinciding surface) of the two frusta and thus adjusted to the cylindrical shape and diameter of the textile rope.

For an adequate judgement of the inventive level of the claimed apparatus of the double-frustum shell type it has to be taken into consideration that a pressure lock in the form of a simple funnel, which greatly narrows in the transport direction of the rope, may serve as an inlet lock but not as an outlet lock. Owing to the lower external pressure in the case of an outlet lock, such a simple funnel would expand or be forced apart at the top surface of the frustum, i.e. at its narrow opening, instead of sealing against the material rope. A simple means to overcome this difficulty would be to turn around the funnel-shaped pressure lock just mentioned. In this case, however, it would be extremely difficult to introduce the material into the narrow opening of the funnel and to avoid bulging and an increase in friction during the whole passage of the material. These difficulties are, however, overcome using outlet pressure locks which correspond, in principle, approximately to the shape of two inlet funnels that abut on one another with their narrow portions. In the simplest case of this "turned-around" pressure lock, whose narrow portion faces the room under pressure, this idea implies placing before the lock a funnel-shaped inlet device composed of rubber rings that are positioned directly one behind the other with greatly decreasing diameters. This inlet device may also be replaced by a circular inlet element made, for example, of porcelain or a similar ceramic material. Where required, such non-elastic elements are interchangeable so as to be adjusted to the different diameters of the rope material.

Several systems, which may be different from each other but work according to the same principle, are suitable to meet the industrial requirements for reliable sealing elements used in an entirely regular HT wet treatment of rope materials difficult to handle.

The sealing device of the invention may perform the same function in quite a variety of methods for the wet treatment of textiles in rope form, for which a regular penetration of the fibrous material with the liquid is important. The most important function of the new pressure lock is doubtlessly its application in dyeing processes where irregularities during the dyeing operation become most apparent. Using the apparatus of the invention means an appreciable technical advantage in this field.

Figure 1A:
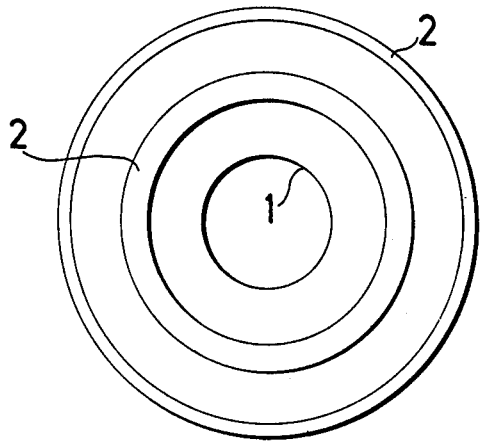
Figure 2:
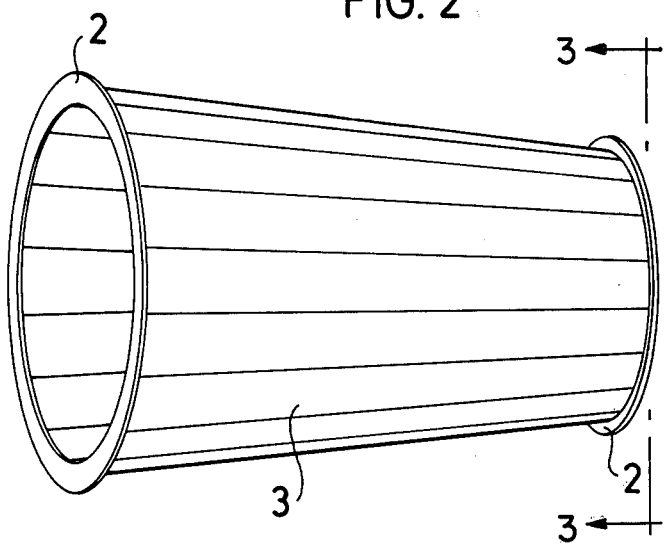
Figure 2A:
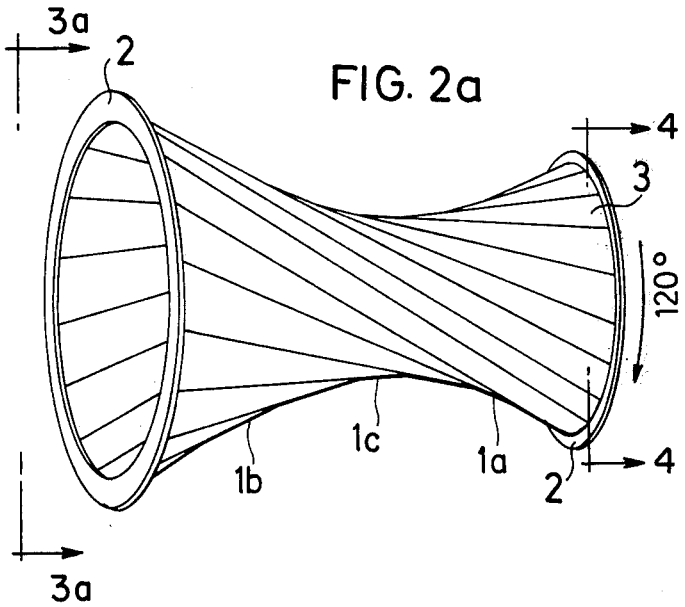
Figure 3:
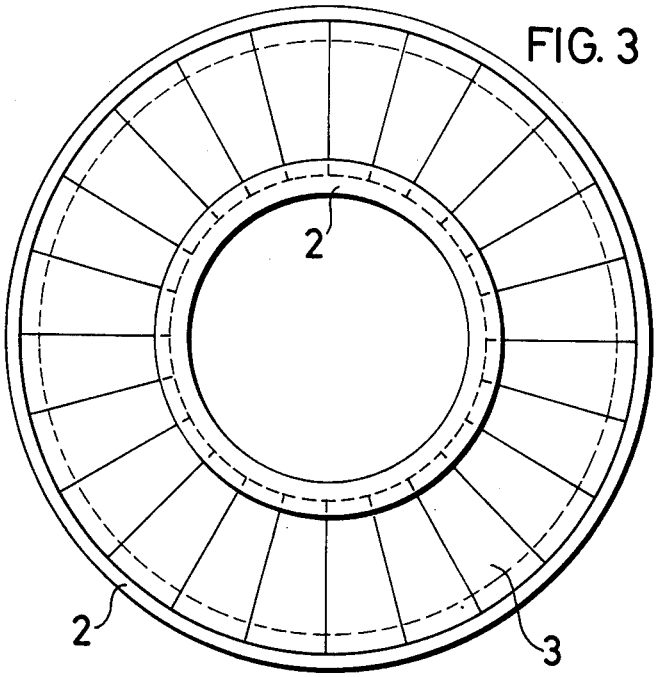
Figure 3A:
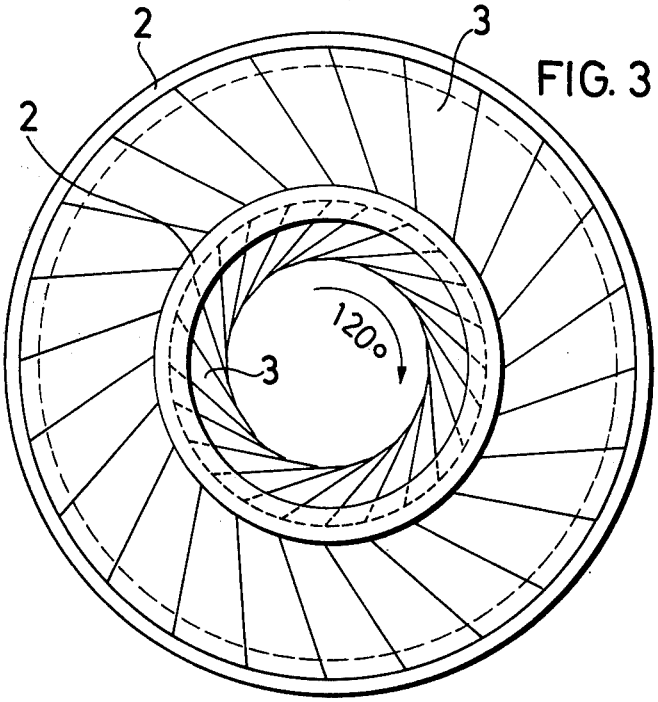
Figure 4:
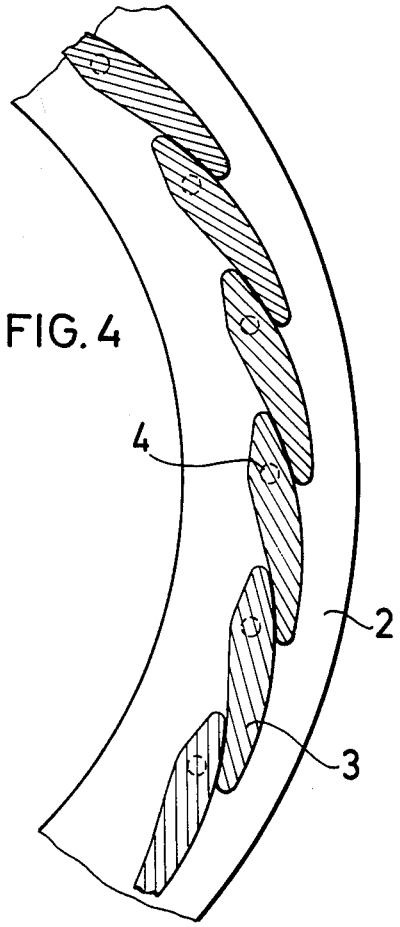
Figure 5:
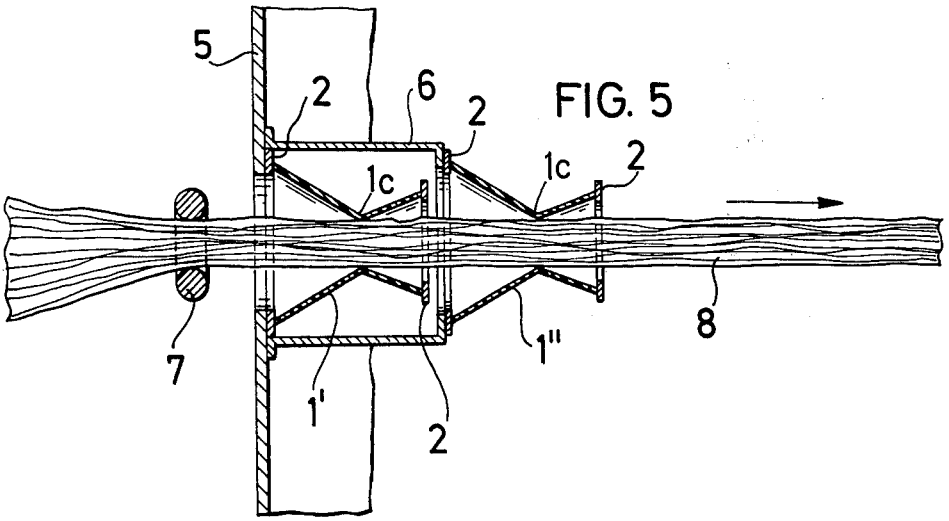

The apparatus of the invention is illustrated diagrammatically by way of example in the accompanying drawings wherein:

FIG. 1 is an elevational view of a sealing element according to the present invention, with part of the element broken away to illustrate its cross-sectional appearance;

FIG. 1*a* is an end view of the sealing element shown in FIG. 1 taken along line 1*a*—1*a* of FIG. 1;

FIG. 2 is a perspective view of another embodiment of the invention formed of a plurality of strip-like lamellae, before being formed into its final shape;

FIG. 2*a* is a perspective view of the sealing element shown in FIG. 2 after twisting to form the double conical shape of the sealing element;

FIG. 3 is an end view of the sealing element of FIG. 2, taken along line 3—3 of FIG. 2;

FIG. 3*a* is an end view of the completed sealing element of FIG. 2*a*, taken along line 3*a*—3*a* of FIG. 2;

FIG. 4 is a partial sectional view taken along line 4—4 of FIG. 2*a*; and FIG. 5 is a side sectional view of the inlet portion of a pressure chamber using pressure locks according to the present invention.

Referring now to the drawing in detail, and initially to FIG. 1 a sealing element 1, constructed in accordance with the present invention is illustrated which is formed as a one piece element having two frustro conical sections 1*a*, 1*b* of different heights whose smaller bases or faces are joined to one another to form a reduced diameter neck 1*c* therebetween. The diameter of this neck is selected to be substantially equal to the diameter of the rope or tow to be drawn therethrough, thereby to form a seal about the rope. Preferably the inner surface 1*d* of the element 1 is coated with a low friction material such as polytetrafluoroethylene. The wider bases of the one sections 1*a*, 1*b* are secured, in any convenient manner to metal tightening and reinforcing rings 2.

Another embodiment of the present invention is illustrated in FIG. 2, before the neck of the sealing element is formed therein. In this embodiment the shell of the sealing element is formed from a plurality of separate overlapping striplike lamallea. These strips overlap each other as shown in FIG. 4 and their ends are secured in tightening or sealing rings 2. These ends are provided with supports or pins 4 mounted in rings 2 to permit slight rotation of the lamallae on the rings. By this arrangement the rings 2, which preferably have different diameters, can be twisted with respect to one another, preferably between 70° and 120°. This relative twisting of the rings 2 produces a narrow neck 1*c* in the sealing element at the adjacent small bases of two frustro-conical sections 1*a*, 1*b*, so that the lamellae form of sealing element has essentially the same shape as the sealing element of FIG. 1. These rings are twisted with respect to one another in an amount selected to provide neck 1*c* with a diameter substantially equal to the diameter of the rope or tow to be drawn through the sealing element.

The sealing elements of the present invention are adapted to be used to form pressure locks in a pressure chamber used in the dyeing operation. As seen in FIG. 5 a typical pressure chamber is illustrated having a front wall 5 on which a first sealing element 1' is mounted by the sealing ring 2 on the larger of its frustro-conical sections. This sealing element is located within a first pressure lock or sub-chamber 6 in the main pressure chamber and in which the pressure is greater than atmospheric but less than the pressure in the main chamber. A second sealing element 1'' is mounted on sub-chamber 6 by the ring 2 on its larger base and extends into the main pressure chamber.

In the device shown in FIG. 5 the textile rope 8 is guided into the first sealing element 1' through a guide ring 7, as described above, and the necks 1*c* of the sealing elements 1' and 1'' have a diameter substantially equal to the diameter of rope 8 so that the rope and sealing necks form an effective pressure seal between opposite sides of the necks. In the arrangement the pressure in the subchamber 6 and in the main chamber acts on sealing elements 1', 1'' respectively and presses these neck portions tightly against the rope.

I claim:

1. A sealing device for the inlet and outlet of a continuous textile material in a dry or wet state, and in the form of an endless rope, into and from a pressure tight container that is under high pressure conditions, comprising at least one pressure lock including a sealing element formed of an elastic material, said sealing element having a shell configuration comprising two frustro-conical sections of different height having complementary small base portions located adjacent each other to define a narrow neck in the sealing element and larger, different diameter base portions remote from said neck on opposite ends of the sealing element with one of said larger diameter base portions freely protruding into the pressure container, said sealing element having an internal surface lined with a smooth layer, and the inner diameter of said neck of the sealing element being selected to be substantially equal to the diameter of the rope whereby the shell of the sealing element is tightly pressed from all sides by the pressure in said container to engage the inner surface of the sealing element at said neck with the rope to form a pressure seal therebetween.

2. A sealing device as claimed in claim 1, wherein the sealing element consists of a one-piece shell.

3. A sealing device as claimed in claim 1, wherein the sealing element comprises a plurality of axially parallel, overlapping lamellae having opposite end portions, and a pair of reinforcing rings respectively secured to the opposite end portions of said lamellae and defining the large bases of the two frustro-conical sections of the sealing element.

4. A sealing device as claimed in claim 3, wherein the neck in said sealing element is formed by twisting said rings with respect to one another, whereby, by varying the amount of relative twist therebetween the inner diameter of the neck of the sealing element may be varied to conform to the diameter of the rope.

5. A sealing device as defined in claim 1 including a plurality of successively aligned pressure locks of graduated pressure each of which includes one of said sealing elements.

* * * * *